US006608433B1

(12) United States Patent
Kodama et al.

(10) Patent No.: US 6,608,433 B1
(45) Date of Patent: Aug. 19, 2003

(54) COLOR CATHODE-RAY TUBE WITH SHADOW MASK HAVING ATTACHED VIBRATION ATTENUATOR

(75) Inventors: Teruhisa Kodama, Shiga (JP); Tatsuzo Hayashi, Shiga (JP); Satoshi Ohta, Hyogo (JP); Yoshikazu Demi, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 217 days.

(21) Appl. No.: 09/661,534

(22) Filed: Sep. 14, 2000

(30) Foreign Application Priority Data

Oct. 1, 1999 (JP) ..... 11-281388

(51) Int. Cl.[7] ..... H01J 29/07
(52) U.S. Cl. ..... 313/402; 313/407; 313/269
(58) Field of Search ..... 313/402, 403, 313/404, 269, 407

(56) References Cited

U.S. PATENT DOCUMENTS

| | | | | |
|---|---|---|---|---|
| 3,936,691 | A * | 2/1976 | Bakker et al. | 313/404 |
| 4,645,968 | A | 2/1987 | Ragland, Jr. | |
| 4,827,179 | A | 5/1989 | Adler et al. | |
| 5,525,859 | A | 6/1996 | Ito et al. | |
| 5,610,473 | A | 3/1997 | Yokota et al. | |
| 2002/0005689 | A1 * | 1/2002 | Bae et al. | 313/407 |
| 2002/0024283 | A1 * | 2/2002 | Arai | 313/407 |
| 2002/0063507 | A1 * | 5/2002 | Shin et al. | 313/407 |
| 2002/0070652 | A1 * | 6/2002 | Park | 313/402 |
| 2002/0070656 | A1 * | 6/2002 | Kim et al. | 313/407 |

FOREIGN PATENT DOCUMENTS

| | | |
|---|---|---|
| EP | 0 273 493 | 7/1988 |
| GB | 2 258 941 | 2/1993 |
| JP | 3-500591 | 2/1991 |
| JP | 8-77936 | 3/1996 |
| WO | 88 10006 | 12/1988 |

OTHER PUBLICATIONS

Partial European Search Report. EPO FORM 1507.2 (09.94).
European Search Report. EPO FORM 1507 02.93.
Adler, et al: "An Unusual Problem in Vibration Damping: The Flat Tension Mask Computer Tube;" Proceedings of the Ultrasonics Symposium; US, New York; IEEE; vol. 2; Oct. 3–6, 1989; pp. 1093–1097.

* cited by examiner

*Primary Examiner*—Ashok Patel
*Assistant Examiner*—Glenn Zimmerman
(74) *Attorney, Agent, or Firm*—Merchant & Gould, P.C.

(57) ABSTRACT

A vibration attenuator is attached to a shadow mask in a movable condition without being adhered to the shadow mask. The vibration attenuator has depressions, and is attached to the shadow mask by inserting its foot portions through holes provided in the shadow mask, and folding them at the depressions, thereby deforming the vibration attenuator into an approximately rectangular shape. Because a vibration energy of the shadow mask is consumed by friction due to a contacting or sliding of the vibration attenuator with the shadow mask, vibration of the shadow mask can be attenuated effectively with a simple structure.

7 Claims, 6 Drawing Sheets

COLOR CATHODE-RAY TUBE WITH SHADOW MASK HAVING ATTACHED VIBRATION ATTENUATOR

FIELD OF THE INVENTION

The present invention relates to a color cathode-ray tube used in televisions, computer displays, and the like, particularly to a color cathode-ray tube using a particular shadow mask.

BACKGROUND OF THE INVENTION

In recent color cathode-ray tubes, in order to reduce the reflection of external light and provide a good appearance, a face panel has been made flat, and correspondingly a shadow mask also has been made flat. When the shadow mask is made flat, the flatness of the shadow mask cannot be maintained by merely supporting the body of the shadow mask with a mask frame.

Also, when merely supported with a mask frame, the shadow mask is vibrated easily by a vibration from the outside, and the display image of the color cathode-ray tube is adversely affected. Therefore, the shadow mask is stretched and fixed on the mask frame by applying a certain amount of tension to the shadow mask.

On the other hand, the impact of electron beams onto a shadow mask causes a doming in which a shadow mask surface is deformed by thermal expansion. By making the shadow mask surface flat, the displacement of an electron beam due to doming increases, particularly in the vicinities of both ends of the screen. To prevent this, the above-mentioned stretching and fixing of a shadow mask is effective because the thermal expansion due to the impact of electron beams can be absorbed by the tension.

Although irregularity in color due to doming can be prevented in the stretched type shadow mask, a vibration of the shadow mask transmitted from outside, such as a vibration transmitted from a speaker, cannot be restrained completely only by the tension applied to the shadow mask.

In order to decrease such a vibration of a shadow mask, a damper wire may be stretched on the shadow mask surface, or the damper wire may be welded to the shadow mask. However, when using such a damper wire, its shadow is reflected in the display image of the color cathode-ray tube, so that the image quality is decreased. Up to the present, various measures have been proposed for absorbing the vibration without causing such problems.

For example, JP 3-500591 A proposes a vibration attenuator including a rigid body fixed at a periphery of a shadow mask and a resistive body that is connected to the rigid body and is separated from the shadow mask. By providing such a vibration attenuator, a vibration energy is extracted from the shadow mask by the rigid body fixed to the shadow mask, and the extracted vibration energy is transmitted to the resistive body, where it is extinguished.

However, a conventional color cathode-ray tube having the above-mentioned vibration attenuator has the following problem.

In the above-mentioned vibration attenuator, the rigid body is fixed integrally to the shadow mask by welding, etc. Thus, the rigid body itself does not have the function of extinguishing the vibration energy, but strictly it is the means for extracting the vibration energy. The extracted vibration energy cannot be extinguished until it is transmitted to the resistive body, which is provided separately. Thus, such a vibration attenuator has a complex structure, which becomes a hindrance in the aspects of cost and productivity.

SUMMARY OF THE INVENTION

The present invention solves the above-mentioned conventional problem, and has an object to provide a color cathode-ray tube in which a vibration of a shadow mask can be attenuated with a simple structure.

In order to solve the above-mentioned problems, the present invention provides a color cathode-ray tube in which a shadow mask, to which a tension is applied, is held by a mask frame and is included in the color cathode-ray tube, wherein a vibration attenuator is attached to the shadow mask in a movable condition, and the vibration attenuator has a depression and is folded at the depression.

Accordingly, a vibration attenuator that can attenuate a vibration of a shadow mask can be formed easily.

That is, because the vibration attenuator is attached to the shadow mask in a movable condition, a vibration energy of the shadow mask is consumed by a friction due to the contacting and sliding of the vibration attenuator with the shadow mask, so that a vibration of the shadow mask can be attenuated with a simple structure.

Furthermore, by providing the vibration attenuator with a depression at a folding portion, folding of the vibration attenuator is made easy, and also the vibration attenuator can be attached with good precision. Therefore, a stable effect of vibration attenuation can be obtained, and also a color cathode-ray tube having a vibration attenuator not hindering the display image can be obtained.

Furthermore, in the color cathode-ray tube of the present invention, it is preferable that the vibration attenuator is formed into an approximately rectangular shape by being folded at the depression.

Accordingly, the vibration attenuator can be attached to the shadow mask easily.

Furthermore, in the color cathode-ray tube of the present invention, the vibration attenuator may be further folded at least one time at a position away from the depression to the side of an end. Accordingly, the folding distance can be controlled easily, and also a color cathode-ray tube having a vibration attenuator not hindering the display image can be obtained.

Furthermore, in the color cathode-ray tube of the present invention, it is preferable that the depression is formed by cutting or compression.

Accordingly, the depression can be formed easily.

Furthermore, in the color cathode-ray tube of the present invention, it is preferable that the depth of the depression is not more than 50% with respect to the thickness of the vibration attenuator.

Accordingly, a vibration attenuator that can be folded easily and maintains its strength can be obtained.

Furthermore, in the color cathode-ray tube of the present invention, it is preferable that the shadow mask is approximately rectangular, and the vibration attenuator is attached on a short side of the rectangle.

Because in general a shadow mask is held by a mask frame at its long sides, a large effect of vibration attenuation can be obtained by attaching the vibration attenuator on a short side of the shadow mask, which is a free end at which the amplitude of vibration becomes the greatest.

PREFERRED EMBODIMENT OF THE INVENTION

Figure 2:
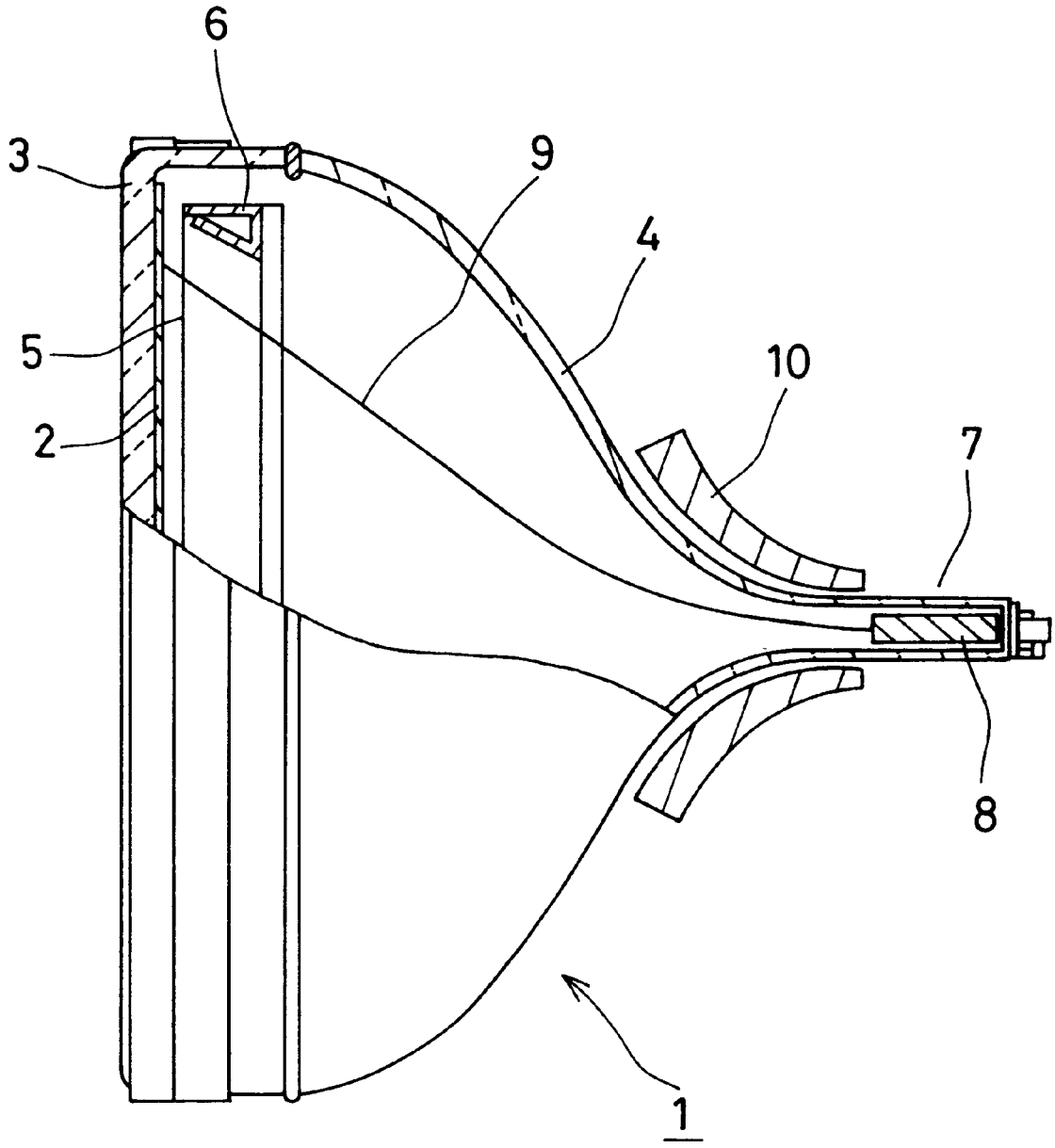
FIG. 2 is a partial cross-sectional view of a color cathode-ray tube according to the present invention.

In the following, an embodiment of the present invention is described in detail with reference to the drawings. FIG. 2 shows a color cathode-ray tube 1 according to this embodiment, in which a face panel 3 with a phosphor screen face 2 formed on its inner surface and a funnel 4 comprise an envelope, and a shadow mask 5 facing the phosphor screen face 2 and a mask frame 6 for holding the shadow mask 5 are contained in the envelope. Furthermore, an electron gun 8 is contained in a neck portion 7 of the funnel 4, and a deflection yoke 10 for deflecting and scanning an electron beam 9 ejected from the electron gun 8 is provided on an outer peripheral surface of the funnel 4. The shadow mask 5 plays a role of color selection, so that three electron beams irradiate phosphors of corresponding colors.

Figure 3:
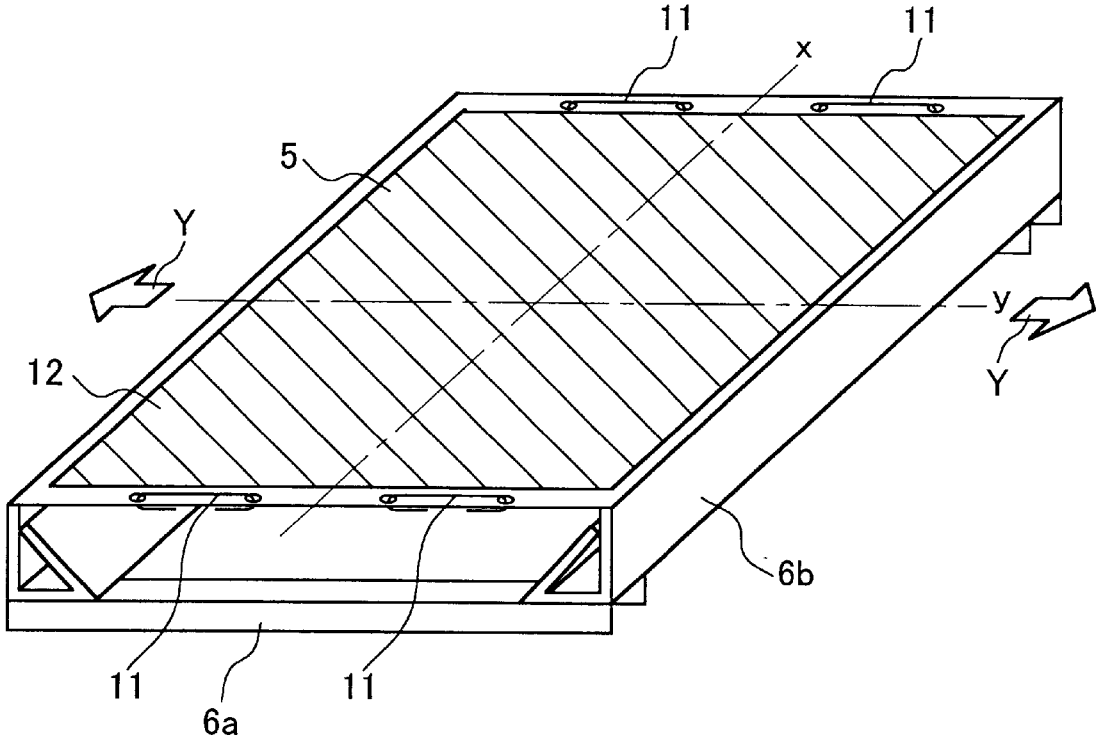
FIG. 3 is a perspective view of a shadow mask assembly in a color cathode-ray tube according to the present invention.

FIG. 3 is a perspective view of a shadow mask assembly in a color cathode-ray tube according to this embodiment.

A mask frame 6 is a rectangular frame that is formed from two short-side frame members 6*a* and two long-side frame members 6*b*. In this embodiment, the shadow mask 5 is provided with a tension in one-dimensional direction along the short axis y (the direction of an arrow Y). Furthermore, although not shown in the drawing, a number of approximately rectangular-shaped apertures for passing electron beams regularly are arranged in the shadow mask 5. In this drawing, a region 12 with apertures for passing electron beams is shown by diagonal lines.

In this embodiment, a 25 inch type (a screen with a diagonal of about 60 cm) with an aspect ratio of 4:3 was used as an example of the color cathode-ray tube, and an iron material with a thickness of 100 $\mu$m was used as the shadow mask. Furthermore, the tension applied to the shadow mask was about 600 Kg in the vicinities of the center, and about 400 Kg in the peripheries at right and left.

Figure 4:
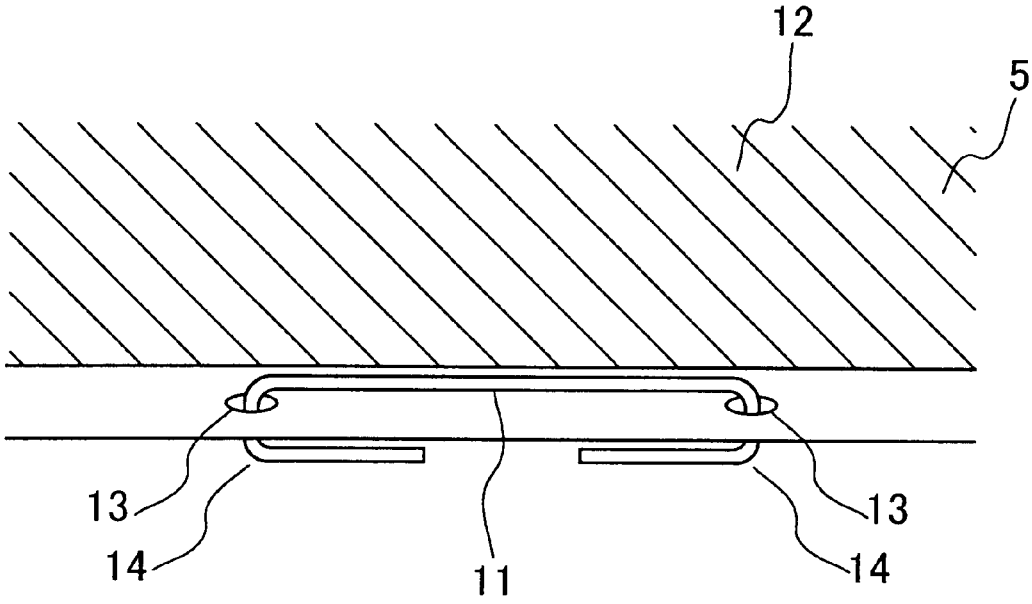
FIG. 4 is an enlarged perspective view of a portion of attaching a vibration attenuator in a color cathode-ray tube according to the present invention.

The shadow mask assembly has vibration attenuators 11 at both right and left ends of the shadow mask 5. As shown in FIG. 4, the vibration attenuators 11 are attached to holes 13 formed outside the region 12 with apertures for passing electron beams of the shadow mask 5, and are formed into an approximately rectangular shape by inserting a linear member having an approximately angular U-shape through the holes 13 and folding it in turn.

Figure 1A:
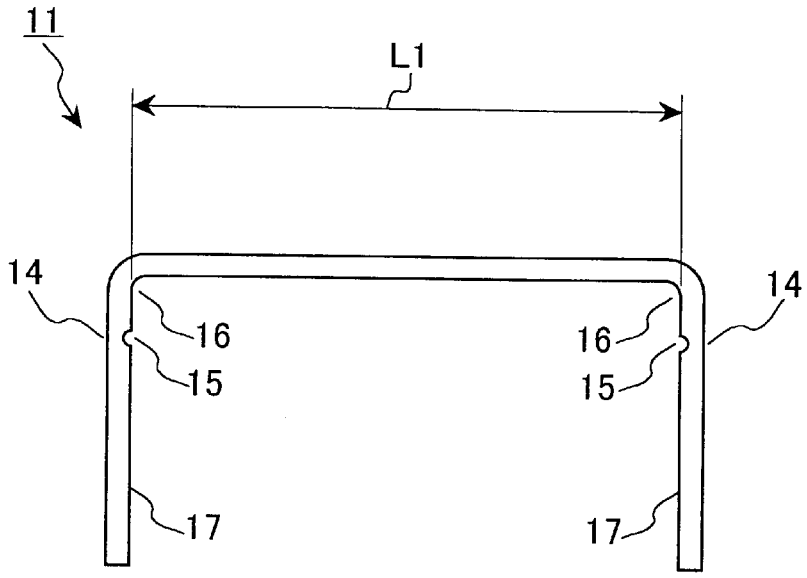
FIG. 1A shows a depression of a vibration attenuator in a color cathode-ray tube according to the present invention.
Figure 1B:
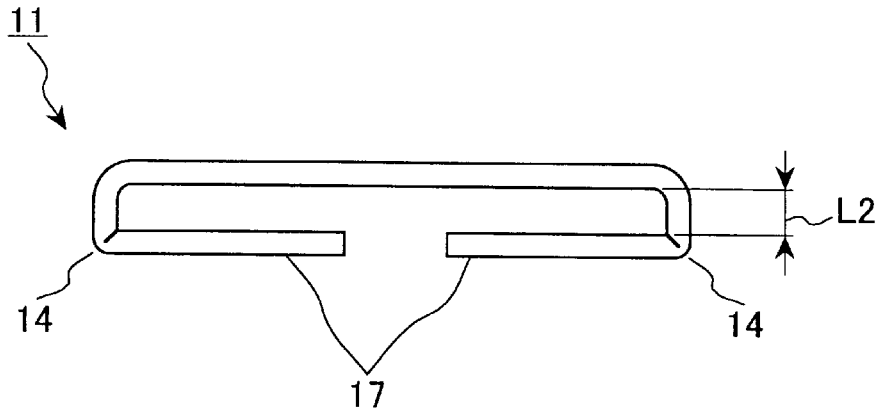
FIG. 1B shows a shape of a folded vibration attenuator in a color cathode-ray tube according to the present invention.

As illustrated in FIG. 1A, the vibration attenuators 11 are provided with depressions 15 in the folding portion 14 in advance. These depressions 15 are positioned away from corners 16 of the angular U-shaped member to the side of foot portions 17, and are formed by cutting. By inserting the foot portions 17 through the holes 13 and folding them at the depressions 15 as in FIG. 1B, approximately rectangular shaped vibration attenuators 11 are formed.

In this embodiment, in the vicinities of the short-side frame members 6*a* of the shadow mask 5, outside the region 12 with apertures for passing electron beams, a total of four vibration attenuators 11 are arranged uniformly at the same distance from the long axis x to the sides of the long-side frame members 6*b*. The distance from the long axis x to the center of one hole 13, which is closer to the long axis x than the other hole 13 among the two holes 13 for attaching respective vibration attenuators 11, is 40 mm. Furthermore, the vibration attenuators comprised a metal wire that was 130 mm in overall length, 0.9 mm in diameter, and 0.7 g in weight. The length L1 of the central linear portion was 70 mm, and the folding distance L2 was 1.5 mm.

Because the diameter of the holes 13 of the shadow mask is made a little larger than the diameter of the vibration attenuators 11, there are no adhered portion between the shadow mask 5 and the vibration attenuators 11, and the vibration attenuators 11 are movable in a condition attached to the shadow mask 5.

According to this structure, when the shadow mask 5 vibrates, the vibration attenuators 11 hardly move integrally with the shadow mask 5, and the vibration attenuators 11 vibrate independently from the shadow mask 5. That is, because the vibration attenuators 11 vibrate while repeating contacting, sliding, or temporal separation with or from the shadow mask 5, the vibration energy of the shadow mask 5 is consumed by the friction due to such contacting or sliding of the vibration attenuators 11 with the shadow mask 5.

Furthermore, by providing depressions in the folding portions of the vibration attenuators as in this embodiment, folding of the vibration attenuators is made easy, and also the vibration attenuators can be formed and attached with good precision.

When such depressions 15 as in this embodiment are not provided in the folding portions 14, the assembling precision of the vibration attenuators is not maintained constant, and for example, individual vibration attenuators may have different values of the folding distance L2, or may be irregular in the direction of the folded foot portions 17. As a result, adverse effects are generated. For example, when the L2 is too small, the vibration attenuators are attached to the shadow mask in an immovable condition, so that their role of vibration attenuation is not displayed. Furthermore, when the L2 is too large, the vibration attenuators are attached in an inclined condition, and the direction of the foot portions 17 may become such that the foot portions 17 reach the region 12 with apertures for passing electron beams. In this case, the shadows of the foot portions 17 might appear on the region 12 and thereby hinder the display image.

Although the folding distance L2 in the state of being folded at the depressions 15 is determined as 1.5 mm in this embodiment, the present invention is not limited to this. However, as mentioned above, when the folding distance L2 is too small, the vibration attenuators become difficult to move, and their effect of vibration attenuation is decreased. On the other hand, when the L2 is too large, the vibration attenuators move too much, and become a hindrance to the display image. For example, when vibration attenuators with a diameter of about 1 mm are attached to a shadow mask with a tension of about 400 to 600 Kg and a thickness of 100 $\mu$m as in this embodiment, it is preferable that the folding distance L2 is in the range of 0.6 to 2 mm. However, the value L2 can be selected as appropriate depending on the tension and thickness of the shadow mask, and the weight and size of the vibration attenuators.

Figure 5:
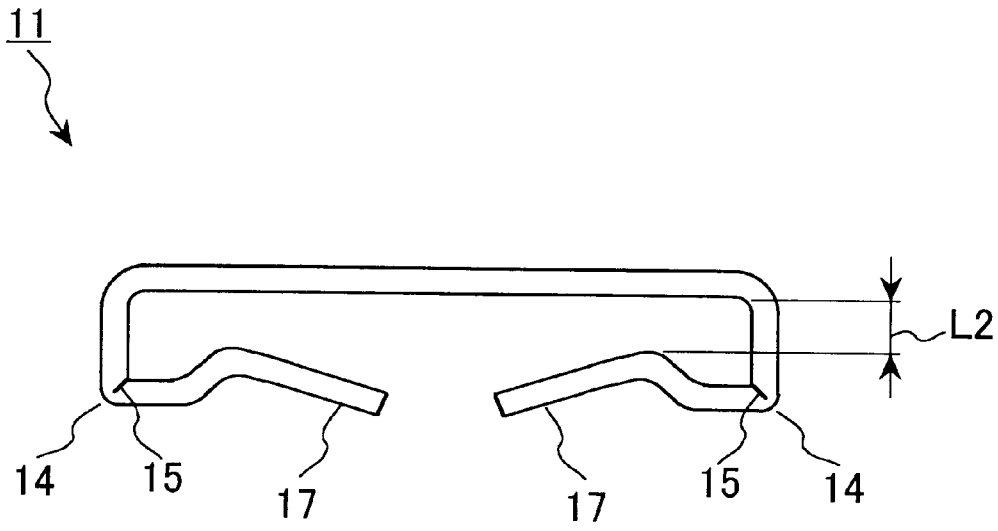
FIG. 5 shows another shape of a folded vibration attenuator in a color cathode-ray tube according to the present invention.

As another preferable example of the vibration attenuator, as illustrated in FIG. 5, in addition to the folding at the depressions 15, the vibration attenuators may be further deformed at least one time by adding a force from the upper or lower side at a predetermined position away from the depressions 15 to the side of foot portions 17. In this case, as shown in FIG. 5, it is also preferable that the closest distance between the opposing wires is defined as the folding distance L2, and the L2 is made within the above-mentioned range.

Figure 6:
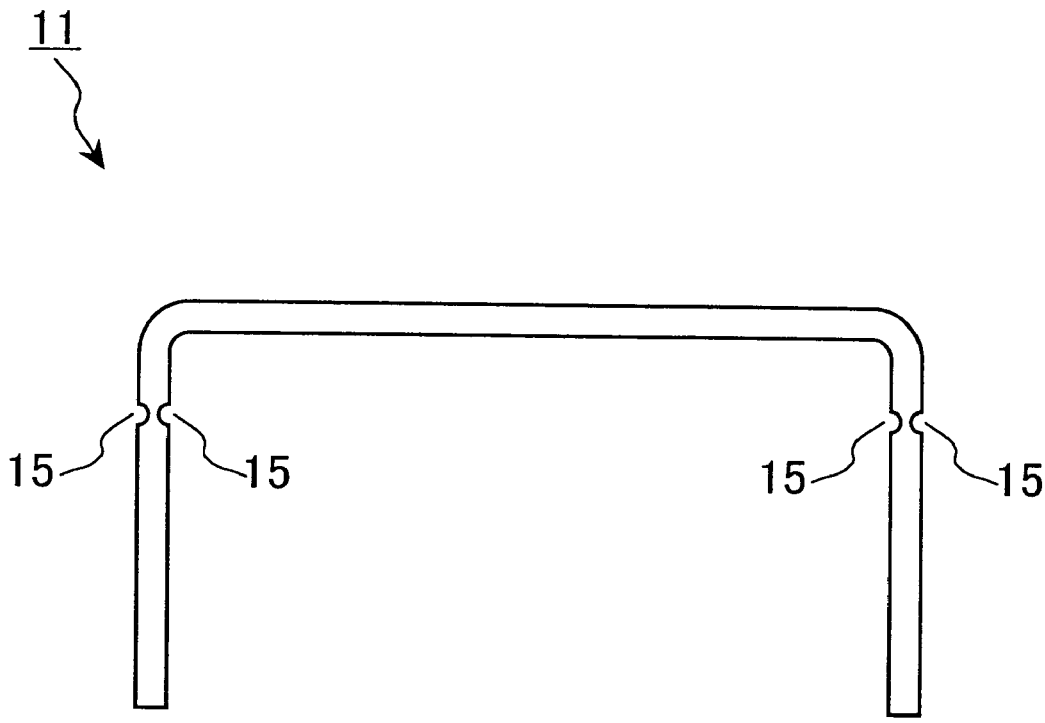
FIG. 6 shows another example of a depression of a vibration attenuator in a color cathode-ray tube according to the present invention.

Furthermore, although the depressions 15 are formed by cutting in this embodiment, for example, as shown in FIG. 6, the same effects can be obtained when the depressions 15 are formed by sandwiching the vibration attenuators with a certain apparatus and thereby compressing it. Furthermore, it is preferable that the depth of the depressions 15 is not more than 50% with respect to the thickness of the vibration attenuators, so that the vibration attenuators can be folded easily and their strength can be maintained. The positions at which the depressions are formed may be in any of the same side (FIG. 1), the opposite side, and both of these (FIG. 6) with respect to the folding direction of the foot portions 17. When the depressions are formed on both sides with respect to the folding direction as in FIG. 6, the depth of the depressions 15 herein refers to the total depth of the depressions on both sides.

Furthermore, the vibration attenuators are not limited to a wire shape, and the present invention also may be applied to a plate shape with a small width, etc.

Furthermore, although this embodiment shows an example in which the depressions are provided in the folding portions 14 of the vibration attenuators, it goes without saying that provision of such depressions at the corners 16 of the angular U-shaped member also enables easy folding when forming the vibration attenuators into the angular U-shape.

Furthermore, although this embodiment shows an example in which a total of four vibration attenuators 11 are attached outside the region with apertures for passing electron beams in the shadow mask 5, the vibration attenuators also may be attached inside the region with apertures for passing electron beams. In this case, it is necessary to attach the vibration attenuators to any portions of the region other than the apertures for passing electron beams, so that the display image of the color cathode-ray tube is not affected. Furthermore, the number of the vibration attenuators is not limited to four, and it can be determined as appropriate depending on the size of the color cathode-ray tube, the tension and thickness of the shadow mask, and the weight of the vibration attenuators, etc.

Furthermore, although this embodiment has been described using a shadow mask having a plurality of apertures, the present invention also may be applied to a shadow mask having a number of approximately parallel (stripe-like) grill tapes, in which color selection is carried out with long thin slits formed between adjacent grill tapes (so-called aperture grill).

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A color cathode-ray tube comprising:

a mask frame;

a shadow mask held by the mask frame with a tension being applied to the shadow mask; and a vibration attenuator that is attached to the shadow mask and moves relative To the shadow mask upon vibration of the shadow mask;

wherein the vibration attenuator is a member different from the mask frame and is not fixed to the mask frame; and the vibration attenuator has a depression, and is folded at the depression.

2. The color cathode-ray tube according to claim 1, wherein the vibration attenuator is formed into an approximately rectangular shape by being folded at the depression.

3. The color cathode-ray tube according to claim 1, wherein the vibration attenuator is further folded at least one time at a position between the depression and an end.

4. The color cathode-ray tube according to claim 1, wherein the depression is formed by cutting.

5. The color cathode-ray tube according to claim 1, wherein the depression is formed by compression.

6. The color cathode-ray tube according to claim 1, wherein a depth of the depression is not more than 50% with respect to a thickness of the vibration attenuator.

7. The color cathode-ray tube according to claim 1, wherein the shadow mask is approximately rectangular, and the vibration attenuator is attached on a short side thereof.

* * * * *